US005189857A

United States Patent [19]

Herren et al.

[11] Patent Number: 5,189,857

[45] Date of Patent: Mar. 2, 1993

[54] FLUSH MOUNT BRIDGING AND BACKING

[76] Inventors: Thomas R. Herren, 128 Cerritos, Long Beach, Calif. 90802; Gene Carpenter, 6221 E. Onyx La., Anaheim Hills, Calif. 92807

[21] Appl. No.: 731,549

[22] Filed: Jul. 17, 1991

[51] Int. Cl.[5] ..... E04C 2/42

[52] U.S. Cl. ..... 52/317; 52/664; 52/721

[58] Field of Search ..... 403/230, 231; 52/290, 52/696, 660, 663, 664, 721, 317, 650, 721, 664

[56] References Cited

U.S. PATENT DOCUMENTS

| | | | |
|---|---|---|---|
| 893,815 | 7/1908 | Schutt | 52/696 |
| 1,737,049 | 11/1929 | Kelly | 52/660 |
| 2,106,084 | 1/1938 | Coddington | 52/721 |
| 2,267,477 | 12/1941 | Siebenlist | 52/290 |
| 2,351,127 | 6/1944 | Hodson | 52/663 |
| 3,680,271 | 8/1972 | Satchell | 52/696 |
| 4,464,074 | 8/1984 | Green et al. | 403/230 |
| 4,608,801 | 9/1986 | Green et al. | 52/664 |

FOREIGN PATENT DOCUMENTS

| | | | |
|---|---|---|---|
| 2539442 | 7/1984 | France | 52/721 |

*Primary Examiner*—James L. Ridgill, Jr.
*Attorney, Agent, or Firm*—Charles H. Thomas

[57] ABSTRACT

A versatile cross connecting device is provided to allow, alternatively, either bridging or backing between adjacent metal studs. Such metal studs are "U-shaped" members with a broad base and narrower sides of uniform height. The studs are arranged in vertical alignment with their flat sides defining the planes of wall surfaces on opposite sides of the studs. The cross connecting device is formed with a channel having a base and sides that extend outwardly from the base. The channel is of a width equal to the width of the studs. The length of the channel is equal to the distance between a base of one of the studs and the closest extremities of the sides of an adjacent stud. The cross connecting device is provided with a transverse end plate located at one end of the channel and extending perpendicular to the alignment of the channel and also a tongue at the opposite end of the channel. The tongue has a proximal portion that extends outwardly from the channel base and a terminal portion that extends parallel to the end plate. The tongue fits between the sides of a stud. The length of the device between the end plate and the terminal portion of the tongue spans the distance between the bases of adjacent studs. The cross connecting device can thereby be mounted either with the channel sides thereof flush with the sides of the studs between which the device is connected, or with the base of the channel flush with the sides of the studs defining the plane of a wall. The cross connecting device is connected to the studs with metal screws.

18 Claims, 2 Drawing Sheets

FLUSH MOUNT BRIDGING AND BACKING

BACKGROUND OF THE INVENTION

1. Field of the Invention

The present invention relates to a device which is useful for both bridging and backing between metal studs in building construction.

2. Description of the Prior Art

In the construction of buildings the framework for the walls of a building is formed of horizontal sill members at the floor at the ends of which vertical corner posts support horizontal headers at the ceiling level above the sills. Between the corner posts there are upright supports, called studs, laterally spaced usually at uniform intervals to provide the necessary interior structural support for the wall.

Historically, the framework of a building wall was formed entirely of wooden members, including wooden studs. In recent years, however, the use of metal studs has gained increasing acceptance, especially in the construction of commercial buildings, such as office buildings and hospitals. It has been found that metal studs can be employed to advantage, since a suitable metal, such as galvanized steel, is stronger than wood, will not rot, is not subject to damage by pests, such as termites, and is economically feasible. The use of metal studs also avoids the depletion of hardwood forests. Furthermore, metal studs are now economically competitive with wooden studs in the building construction industry. Metal building studs are typically formed of ten to twenty gauge galvanized steel.

While wooden studs are formed of solid wood, typically having nominal cross section dimensions of two inches by four inches, the much greater structural strength of metal allows studs to be employed which are not solid, but rather have a channel shaped or "C-shaped" cross section. To conform to the architectural plans and building materials which have been developed over the years based on the use of wooden studs having specific cross sectional dimensions, commercially available metal studs are constructed with the same outer dimensions in which wooden studs have been manufactured for many years. Specifically, metal studs are typically formed of sheet metal bent to encompass a cross sectional area having nominal dimensions of two inches by four inches.

For ease of fabrication the metal studs are formed of sheet metal bent into a generally "U-shaped" cross section and in which a relatively broad central base is flanked by a pair of narrower sides that are bent at right angles to the base. The base typically has a uniform nominal width of either four inches or three and one half inches, and the sides of the U-shaped stud typically extend a nominal distance of two inches from the base. To enhance structural rigidity the edges of the sides of the metal stud are normally bent over into a plane parallel to and spaced from the plane of the base. These turned over edges of the sides thereby form marginal lips which are typically one quarter to one half an inch in width.

In building construction there are certain situations which require the building studs to be braced or linked transversely to provide enhanced structural rigidity. The studs must be transversely bridged when they are over eight feet in length so that they provide adequate stability in a lateral direction within the wall which they support. Also, certain situations require horizontal backing between studs in a building so as to provide structural support to resist forces acting normal to or parallel to the plane of the wall. For example, structural backing must be provided between adjacent studs within a wall against which a flight of stairs is built so as to provide the necessary structural stability for a handrail affixed to the wall. The requirements for structural stability and backing between adjacent studs are particularly stringent in hospitals and schools, the construction of which is closely regulated by governmental agencies. For example, in hospital construction a handrail secured to a wall must be able to resist an outward pull normal to the wall having a force of two hundred pounds, and a downward pull parallel to the plane of the wall having a force of two hundred pounds as well.

The provision of bridging and backing between wooden studs is relatively simple. Lumber is merely cut into short lengths to fit between the facing surfaces of the wooden studs. These short lengths are merely nailed in position. Boards that are cut to length from the same lumber stock used for stud construction may be inserted between adjacent studs with their broadest surfaces residing in a generally horizontal disposition to form bridging between adjacent studs. The same type of lumber may be cut into boards which are inserted between adjacent studs with their broadest faces residing in coplanar alignment with the edges of the studs facing the wall surface to be reinforced to provide backing between adjacent studs.

As previously noted, metal studs are not solid structures, but are essentially three sided hollow channels with relatively thin marginal lips turned over on the fourth, open side. The metal reinforcing material for use in forming bridging and backing is of the same construction. As a consequence, the metal sections of channel stock used for bridging and backing between adjacent metal studs have no end surfaces which can be fastened to the broad base portions of the upright studs.

In order to provide bridging and backing between metal studs it has been the practice to employ metal channels formed of essentially the same channel shaped stock as the metal studs by cutting that stock in lengths long enough to overlap the narrow sides of the studs facing the wall surface. Notches are cut out of the sides of the metal stock used to provide bridging and backing so that the base portions of the bridging and backing channels reside in direct contact with the sides of the metal studs facing the wall. Holes are drilled through the bases of the bridging and backing channels between the notched sides thereof and into the upright sides of the metal studs directly behind them. Metal screws are then used to fasten the notched bridging and backing channels to the narrow sides of the upright studs.

While the conventional technique for providing metal studs for bridging and backing does create structural stability, it also presents certain problems. Specifically, since the base portion of the notched channel stock passes over the sides of the studs facing the wall of the room, an outward protrusion into the room is created to the extent of the thickness of the base portion of the channel stock forming the bridging or backing. Furthermore, the heads of the screw which fasten the notched channel stock to the studs protrude outwardly beyond even the extra thickness of metal of the base portion of the channel stock. While the studs and cross connecting channel stock are all covered over with wallboard, nevertheless the extra thickness of the base portion of the cross connecting channel stock and the screwheads that fasten that channel stock to the studs causes the wallboard to protrude into the room at the locations where the studs are reinforced with bridging or backing. This inward protrusion detracts from the aesthetic appearance of the wall.

A further disadvantage of the existing technique for cross connecting metal studs is that the notched channel stock can only be mounted with the relatively broad base member of the cross connecting channel stock residing in a vertical plane adjacent the plane of only the adjacent sides of the studs against which the channel stock is positioned. Conventional cross connecting channel stock cannot be mounted in a generally horizontal disposition across the width of the metal stud in the manner of bridging between wooden studs, so as to provide structural rigidity across the entire width of the studs. That is, the conventional cross connecting notched channel members provide reinforcement only on the sides of the metal studs upon which they are mounted. Little reinforcement is provided for the opposite sides of the metal studs. As a consequence, notched metal cross connecting members must be mounted on both sides of the studs to achieve the structural reinforcement of bridging. This requires two metal cross members to achieve the stability provided by each wooden bridging cross connecting member conventionally used in cross connecting wooden studs.

SUMMARY OF THE INVENTION

The present invention provides a versatile device which can be utilized alternatively for either bridging or backing metal studs in a building. Cross connecting devices according to the invention are designed for use between uniform metal upright studs that are mounted at laterally spaced intervals within a building, each stud being of a uniform width and formed with a base having front and back surfaces and parallel sides. These sides extend from the front surface of the base to a predetermined height.

The cross connecting device of the invention is comprised of a "U-shaped" channel having opposite ends and having the same width as the studs and formed in a length that spans the distance from the back surface of the base of one stud to the sides of an adjacent stud. The U-shaped channel of each cross connecting device is comprised of a base and a pair of side walls that are preferably no greater than about one and one half inches in height rising form the base. The device also includes an end tab that is disposed transversely across one of the ends of the channel normal to the alignment thereof, and a tongue located at the opposite end of the channel and formed in a width so as to fit in between the sides of one of the studs. The tongue has a tip that extends parallel to the end tab, whereby the length of the device between the tip of the tongue and the end tab span the distance between the back surface of the base of one of the studs and the front surface of the base of an adjacent stud.

The tongue preferably has a "Z-shaped" configuration that includes a proximal section that extends from the base of the channel parallel to the end tab at the opposite end of the channel therefrom, and an intermediate section that extends longitudinally away from the end tab and terminates at the tip. The proximal section of the tongue preferably extends from the base of the channel a maximum distance of about one and one half inches. The intermediate section of the tongue is preferably no greater than about one and one half inches in length, and the tip of the tongue is preferably no greater than about one and one half inches in length as well. The end tab of the cross connecting device is preferably no greater than about two inches in height.

The width of the channel should be the same as the width of the studs with which the cross connecting devices are to be used. That is, where the studs are nominally four inches in width the channels of the cross connecting devices likewise should be four inches in width. For use with studs three and one half inches in width the channels of the cross connecting devices likewise should be three and one half inches in width. Metal studs which are employed commercially in building construction range between three and one half and six inches in width, and the channel width of the cross connecting devices should match the stud width. Metal studs four inches in width predominate in the building construction industry, so that cross connecting devices having channels with this same width will likewise be predominantly utilized.

The length of the cross connecting device of the invention will vary with the stud layout of the building in which stud bridging or backing is required. Very typically the studs are placed sixteen inches on center, and are often formed of sixteen gauge galvanized steel, which is 0.0625 inches in thickness. Consequently, the overall length of the cross connecting devices utilized in such a stud layout will be 15.9375 inches as measured from the plane of the outwardly facing surface of the transverse end tab to the plane of the outwardly facing surface of the tip of the tongue at the opposite end of the channel. Where different stud spacing is specified, the length of the cross connecting devices employed will be changed accordingly.

One primary advantage of the present invention over the conventional technique heretofore used for the transverse stabilization or reinforcement of metal studs is that the cross connecting device of the invention can be utilized in alternative manners of orientation. That is, it can be used both for bridging and for backing. When the cross connecting device is utilized for bridging it is oriented with the relatively broad base of the channel in a horizontal disposition, and with the sides of the channel disposed vertically and in respective coplanar relationship with the sides of the adjacent metal studs to which the cross connecting device is fastened.

Since the sides of the channel of the cross connecting device and the sides of the metal studs are oriented in the same parallel vertical planes, there is no protrusion of the cross connecting device whatsoever beyond the parallel planes defined by the sides of the metal studs. In this orientation the transverse end tab of each cross connecting device resides in abutment against the back surface of the base portion of one stud, and the tongue passes between the inwardly turned lips of the sides of an adjacent stud. The tip of the tongue resides in contact with the front surface of the base portion of the adjacent stud. The end tabs and the tips of the tongues of the cross connecting devices are all connected to the bases of the studs against which they are positioned by means of metal screws. The cross connecting devices thereby provide rigidifying, stabilizing support across the entire width of the adjacent studs, without protruding beyond the planes of the sides of the studs. Such a bridging arrangement is utilized for stabilizing lengthy studs at intermediate positions along their lengths and for providing enhanced lateral stability to studs which are to be subjected to particularly heavy loads.

The cross connecting devices may also be employed in a backing arrangement in which the base of the channel of the cross connecting device resides in coplanar relationship with the sides of adjacent studs that define the plane of a wall of a room. In this arrangement the base portion of the cross connecting device is flush with the sides of the adjacent studs to which the cross connecting device is connected. The transverse end tab of the cross connecting device resides in contact with the back surface of one of the adjacent studs, while the configuration of the tongue of the cross connecting device allows it to clear the side and overhanging lip of an adjacent stud so that the tip of the tongue resides in contact against the front surface of the adjacent metal stud. When mounted in this disposition the cross connecting device provides a sound backing adapted to receive screws that pass through wallboard disposed against the studs for mounting handrails or other devices on the walls of a room or passageway.

In both the bridging and backing the end tab and the tip of the tongue of the cross connecting device are secured to the base portions of the adjacent studs by means of screws designed for use in sheet metal. Whether the cross connecting device of the invention is utilized for purposes of bridging or for purposes of backing, no part of it protrudes beyond the planes defined by the sides of the studs against which wallboard is fastened. The cross connecting device thereby avoids the aesthetically displeasing bumps and irregularities in the walls of a building supported by metal studs of the type which have been characteristic of the prior technique for cross connecting metal studs. Furthermore, the cross connecting device of the invention is suitable for use both in bridging and alternatively in backing, depending upon the manner of its orientation relative to the adjacent studs to which it is fastened.

The invention may be described with greater clarity and particularity by reference to the accompanying drawings.

DESCRIPTION OF THE EMBODIMENT

Figure 1:
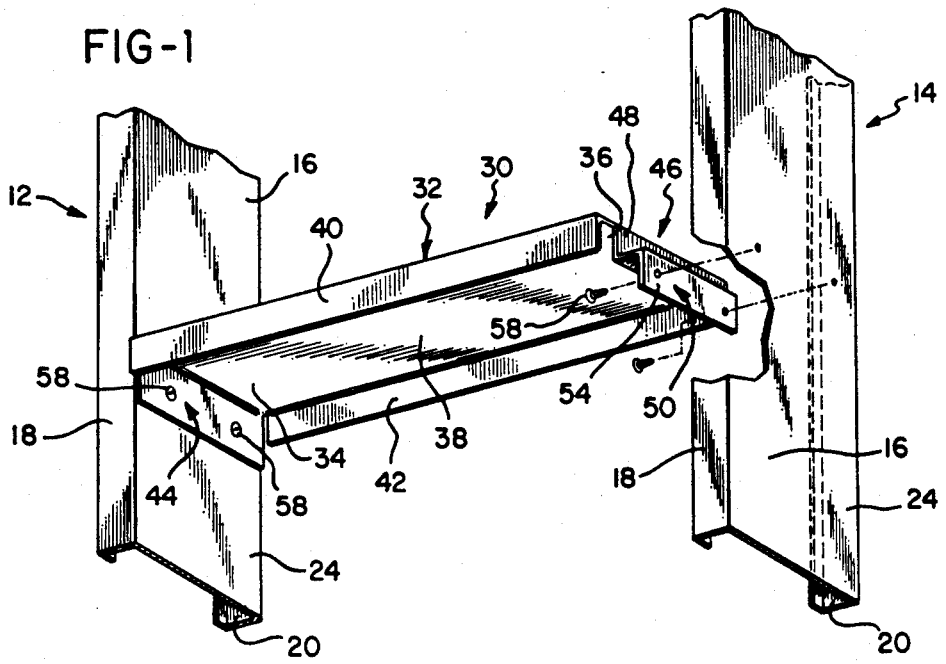
FIG. 1 is a perspective view from beneath showing the cross connecting device of the invention as mounted for bridging between two adjacent metal studs.

FIG. 1 illustrates two adjacent upright metal studs 12 and 14 which are mounted in vertically upright disposition in a building, typically at uniform spaced intervals. Each of the metal studs 12 and 14 is formed of a ingle sheet of sixteen gauge galvanized steel bent into a U-shaped or channel shaped cross sectional configuration so that each stud is formed with a relatively broad base 16 and narrower sides 18 and 20. The sides 18 and 20 are of a uniform height throughout. For example, the sides 18 and 20 may be two inches in height while the bases 16 are four inches in width. The bases 16 each have a front surface 22 and a back surface 24. The sides 18 and 20 are bent at right angles relative to the base 16 and extend outwardly from the front surface 22 of the base 16 parallel to each other and at right angles to the base 16. For additional structural rigidity the edges of the sides 16 and 18 are bent over to form lips 26 and 28, which reside in mutual coplanar relationship and extend toward each other a distance typically between about one eighth of an inch and one half of an inch.

The studs 12 and 14 are all mounted in uniform, vertical parallel alignment with the front surfaces 22 of the stud bases 16 all facing in one direction and with the back surfaces 24 thereof facing in an opposite direction. The sides 18 and 20 of the studs 12 and 14 are both narrower than the base portions 16 and are of a uniform height throughout. The studs 12 and 14 are all of a uniform four inch width. The sides 18 of the studs 12 and 14, and all other studs in the wall all reside in coplanar relationship and are parallel to the building wall in which the studs 12 and 14 are mounted. Likewise, the sides 20 of the studs 12 and 14 and all other studs in the wall also all reside in coplanar relationship and are parallel to the building wall in which they are mounted. The studs 12 and 14 depicted may be considered to be mounted at sixteen inch intervals on center.

The cross connecting device of the invention is indicated generally at 30. The cross connecting device 30 is comprised of a U-Shaped channel 32 formed in a length to fit between the back surface 24 of the base 16 of the stud 12 and the extremities of the sides 18 and 20 remote from the base 16 of the stud 14 which is mounted parallel and adjacent to the stud 12. The channel 32 is formed in a width of four inches which is equal to the four inch width of the studs 12 and 14.

The channel 32 has opposite ends 34 and 36, a generally rectangular base 38, and generally rectangular sides 40 and 42 that extend outwardly from and are substantially normal to the channel base 38. The cross connecting devise 30 also includes a flat, transverse generally rectangular end tab or plate 44 that is disposed normal to the channel base 38 at the end 34 thereof between the channel sides 40 and 42. The cross connecting device 30 also includes a tongue 46 of a width thin enough to fit between the sides 18 and 20 of the stud 14. The tongue 46 is disposed transversely and extends longitudinally away from the end tab 44 at the opposite end 36 of the channel 32. The tongue 46 has a proximal section 48 that extends outwardly from the channel base 38 between the channel sides 40 and 42, and a remote section 50 carried by the proximal section 48 and including a terminal extremity or tip 54 that extends parallel to the end plate or tab 44.

Figure 3:
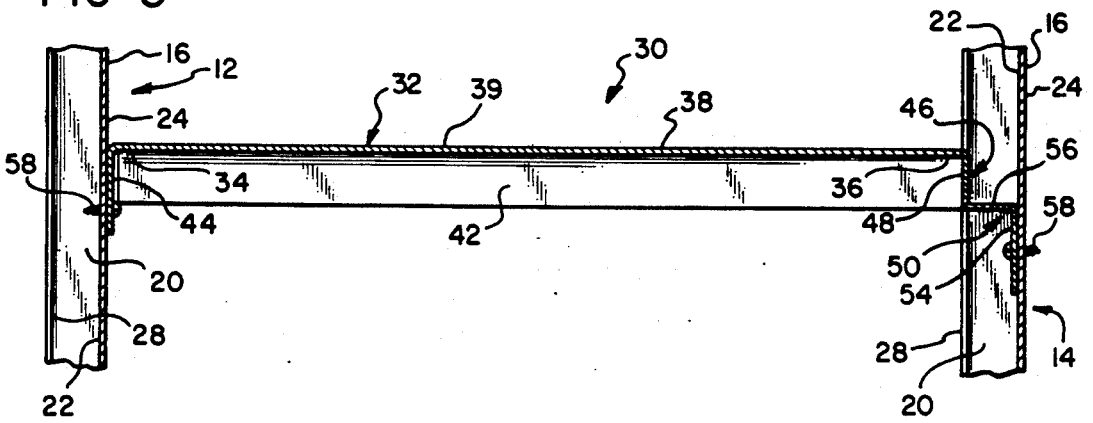
FIG. 3 is a sectional elevational view taken along the lines 3—3 of FIG. 2.
Figure 4:
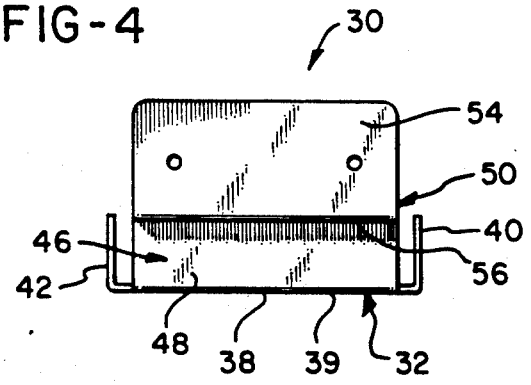
FIG. 4 is an end view of the cross connecting device of the invention.

As best illustrated in FIG. 3 the tongue 46 is shaped in a zig-zag or "Z-shaped" configuration and includes an intermediate portion 56 that extends parallel to the base 38 of the channel 32. The intermediate portion 56 also extends away from the end tab or plate 44 and is perpendicular to both the proximal tongue section 48 and the terminal tip or extremity 54 of the tongue 46.

Figure 2:
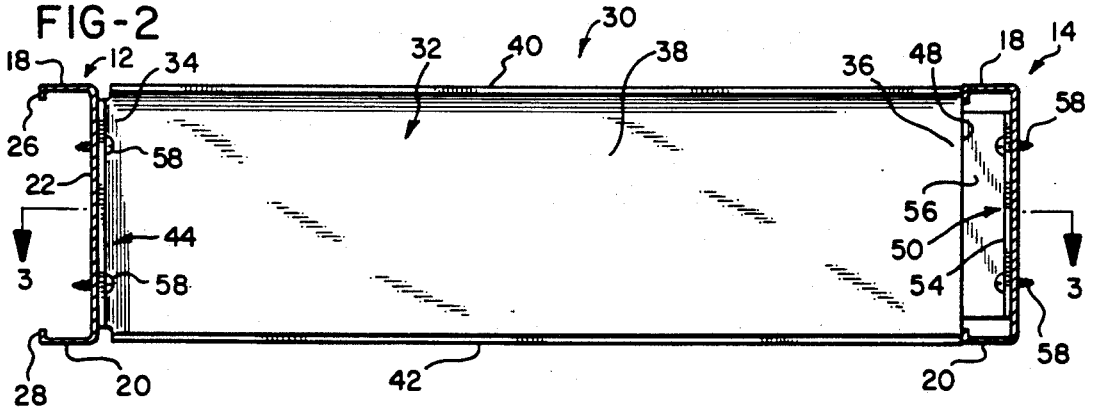
FIG. 2 is a bottom plan view showing the cross connecting device as mounted between studs in FIG. 1.

As best illustrated in FIG. 2, it is necessary for a gap to exist between the tongue 46 and each of the sides 40 and 42 of the channel 32 so that the tongue 46 can fit between the sides 18 and 20 of the stud 14. In the embodiment illustrated the tongue 46 is separated from each of the sides 40 and 42 of the channel 38 by a distance of about one half of an inch.

The cross connecting device 30 is formed from a single sheet of galvanized steel stock having a gauge thickness typically between about 10 and 20. Preferably the gauge thickness is the same as that of the metal studs 12 and 14, which may be 16 gauge.

The overall length of the sides 40 and 42 of the channel 32 is such that the sides 40 and 42 just span the distance between the back surface 24 of the base portion 16 of the stud 12 and the turned over edges of the sides 18 and 20 of the stud 14 which form the lips 26 and 28. The overall length of the cross connecting device 30, as measured from the outwardly directed face of the transverse end tab or plate 44 and the outwardly directed face of the terminal tip or extremity 54 of the tongue 46 is such as to just span the distance between the back face 24 of the base 16 of the stud 12 and the front face 22 of the base 16 of the stud 14. Where the studs 12 and 14 are spaced within the wall of a building at intervals of sixteen inches, on center, the length of the sides 40 and 42 is preferably about fourteen and three eighths inches and the distance between the outwardly facing surfaces of the end tab 44 and the extremity 54 of the tongue 46 is preferably about 15.9375 inches.

The proximal section 48 of the tongue 46 extends from the base 38 of the channel 32 a maximum distance of about one and one half inches. The intermediate section 56 of the tongue 46 is no greater than about one and one half inches in length. The tip 54 of the remote section 50 of the tongue 46 is no greater than about one and one half inches in length as well. The end tab or plate 44 is no greater than about two inches in height from the base 38.

FIG. 1 illustrates the cross connecting device 30 of the invention deployed in a bridging disposition for laterally stabilizing the adjacent studs 12 and 14. In this disposition the base 38 of the channel 32 is disposed horizontally, although in order to insert the tongue 46 between the sides 18 and 20 of the stud 14 it is often necessary to twist the cross connecting device 30 slightly so that the tongue 46 will pass between the lips 26 and 28 on the sides 18 and 20 of the stud 14. Once the tongue 46 has cleared the lips 26 and 28 the device 30 can be straightened so that the base 38 of the channel 32 is in a horizontal disposition. The tongue tip 54 then resides in contact with the front surface 22 of the base 16 of the stud 14. The edges of the sides 40 and 42 of the channel 32 at the end 36 thereof will then reside in abutment against the lips 26 and 28 of the stud 14 to provide enhanced rigidity. At the opposite end of the channel 30 the end plate or tab 44 resides in abutment against the back face 24 of the base 16 of the stud 12.

Holes are thereupon drilled through the end tab 44 and the base 16 of the stud 12 and also through the terminal tip 54 of the tongue 46 and the base 16 of the stud 14. The end tab 44 is thereupon secured to the base 16 of the stud 12 by means of a pair of machine screws 58, while the tip 54 of the tongue 46 is secured to the base 16 of the stud 14 by means of another pair of machine screws 58, as illustrated in FIGS. 1-3.

As is evident from FIG. 2 in particular, the sides 40 and 42 of the cross connecting device 30 reside in coplanar relationship, respectively, with the sides 18 and 20 of the studs 12 and 14. Thus, no unsightly bulge is produced in wallboard that is secured against the sides 18 and 20 of the studs. Furthermore, because the base 38 of the cross connecting device 30 extends across the entire width of the bases 16, the studs 12 and 14 are stabilized throughout their width between their sides 18 and 20.

Figure 5:
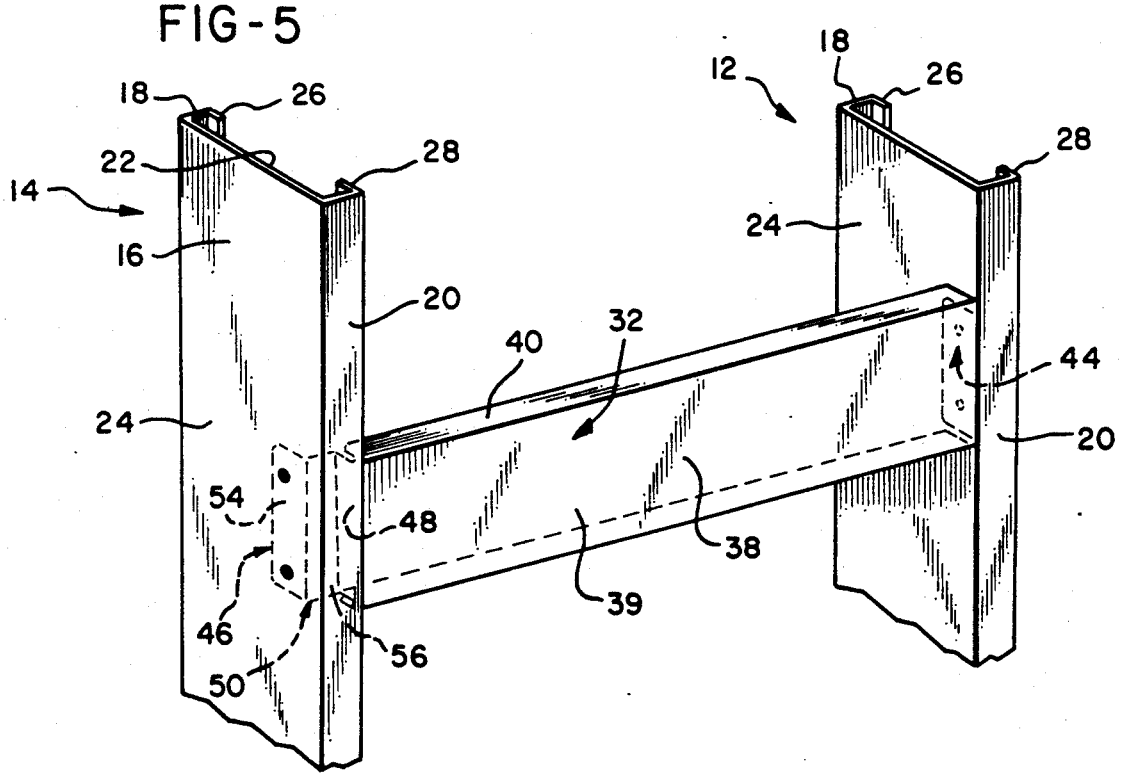
FIG. 5 is a perspective view showing the cross connecting device of the invention mounted in a backing arrangement between two adjacent studs.

FIG. 5 illustrates the manner in which the same cross connecting device 30 is used to provide a backing for a wall attachment, such as a handrail. The cross connecting device 30 is again disposed to extend between the front surface 22 of the base 16 of the stud 12 and the back surface 24 of the base 16 of an adjacent stud 14. However, in this manner of use the cross connecting device 30 is rotated ninety degrees from the orientation in which it is mounted in FIGS. 1-3 as a bridging device so that the outer face 39 of the base 38 of the channel 32 resides in coplanar, flush mounting arrangement with the sides 20 of the studs 12 and 14.

In this arrangement the end tab 44 resides in direct contact against the back surface 24 of the base 16 of the stud 12 and is secured thereto by machine screws 58. At the opposite end of the cross connecting device 30 the proximal section 48 of the tongue 46 resides in abutment against the lip 28 of the stud 14. The proximal section 48 is of a sufficient length so that the intermediate portion 56 clears the lip 28. The length of the intermediate portion 56 is such as to hold the terminal tip 54 of the tongue 46 in abutment against the front face 22 of the stud 14. The tongue 46 is likewise secured to the base 16 of the stud 14 by mean of machine screws 58.

When the cross connecting device 30 is mounted in the manner depicted in FIG. 5, it provides a high degree of stability for securing articles such as handrails and banisters which are fastened to the wallboard disposed against the sides 20 of the studs 12 and 14. Screws from the base of the handrail pass through the wallboard and into the base 38 of the cross connecting device 30. The cross connecting device 30 thereby provides solid, rigid support to loads applied both normal to the wall as well as loads applied parallel thereto.

Numerous variations and modifications of the invention will become readily apparent to those familiar with building construction. For example, a different type of fastening system, such as bent flanges on the cross connecting device which fit into anchoring slits in the studs, might be used to secure the cross connecting device of the invention to metal building studs. Accordingly, the scope of the invention should not be considered as limited to the specific embodiment and the manners of use depicted herein, but rather as defined in the claims appended hereto.

We claim:

1. In combination a plurality of uniform metal upright studs mounted at laterally spaced intervals, each stud being of a uniform width and formed with a stud base having front and back surfaces and parallel stud sides extending from said front surface of said stud base to a predetermined height, and cross connecting devices between said studs, each said device comprising a U-shaped channel having opposite ends and having a uniform width throughout the same as the width of said studs and formed with a channel base and parallel channel sides extending outwardly from said channel base, said device having a length that spans the distance from the back surface of the stud base of one of said studs to the stud sides of an adjacent stud, an end tab disposed transversely across one of said ends of said channel normal to the alignment thereof and extending outwardly from said channel base in the same direction as said channel sides, and a tongue located at the other end of said channel and projecting away from said end tab beyond said channel sides and formed in a width so as to fit between said stud sides and having a tip that extends parallel to said end tab and in the same direction from said channel base as said channel sides, whereby the length of said device between said tip of said tongue and said end tab spans the distance between said back surface of said stud base of one of said studs and said front surface of said stud base of an adjacent stud, and said tongue spans the height of said stud sides.

2. A combination according to claim 1 wherein said intermediate section of said tongue is no greater than one and one half inches in length.

3. A combination according to claim 1 wherein said tip of said tongue is no greater than about one and one half inches in length.

4. A combination according to claim 1 wherein said end tab is no greater than about two inches in height.

5. A combination according to claim 1 further characterized in that said tongue includes a proximal section that extends parallel to said end tab at said opposite end of said channel therefrom, and an intermediate section that extends longitudinally away from said end tab and terminates at said tip.

6. A combination according to claim 5 further characterized in that said proximal section of said tongue has a maximum length of about one and one half inches.

7. A combination according to claim 1 wherein said channel side walls extend from said channel base a distance no greater than about one and one half inches.

8. A combination according to claim 7 wherein said tongue is separated from each of said side walls of said channel by a distance of about one half an inch.

9. A combination according to claim 1 formed from a single sheet of metal.

10. A combination according to claim 9 wherein said sheet of metal is steel having a thickness of between about ten and twenty gauge.

11. In a wall formed with studs having a uniform width and mounted upright and with uniform spacing each stud being formed in a generally U-shaped cross section with a broad stud base and narrower stud sides of a uniform height throughout, the improvement comprising a plurality of cross connecting devices interconnecting said studs each of said cross connecting devices being formed with a channel having a channel base and channel sides that extend outwardly from said channel base, said channel having a uniform width throughout equal to that of said studs and a length equal to the distance between a stud base of one of said studs and the closest stud sides of an adjacent stud, each said cross connecting device further comprising a transverse and plate located at one end of said channel and extending normal to the alignment thereof in the same direction as said channel sides, and a tongue at the opposite end of said channel with a proximal portion that extends outwardly from said channel base in the same direction as said channel sides and a terminal portion that extends in the same direction as said channel sides and parallel to said end plate, whereby said tongue fits between said stud sides of a stud and spans the height of said stud sides, and the length of said device between said end plate and said terminal portion of said tongue spans the distance between the stud bases of adjacent studs.

12. A wall according to claim 11 wherein said tongue of each cross connecting device is further comprised of an intermediate portion located between and normal to both said proximal portion and said terminal portion.

13. A wall according to claim 11 wherein in each of said cross connecting devices there is a gap between said tongue and each of said channel sides of said channel of about one half an inch.

14. A wall according to claim 11 wherein each of said cross connecting devices is formed from a single sheet of steel stock.

15. A wall according to claim 14 in which said steel stock has a gauge thickness of between about ten and twenty.

16. In a wall having metal studs mounted upright therein and in which each of said studs has a uniform width and is formed with a stud base having front and back surfaces and stud sides of a uniform height extending from edges of said front surface of said stud base parallel to each other, the improvement comprising a plurality of connecting devices mounted laterally between said upright studs, each of said connecting devices having a channel formed in a length to fit between the back surface of a stud base of a first stud and the extremities of the stud sides remote from the stud base of a second stud which is mounted parallel and adjacent to said first stud, said channel having a uniform width throughout equal to the width of said studs, opposite ends, a channel base, and channel sides substantially normal to said base, a flat, transverse end tab extending from said channel base in the same direction as said channel sides and disposed normal to said channel sides at one end of said channel, and a tongue of width thin enough to fit between the stud sides of a stud and disposed transversely at the opposite end of said channel and having a proximal section extending outwardly from said channel base between said channel sides and a remote section carried by said proximal section and including an extremity that is disposed normal to said channel base and beyond said channel sides, whereby each said device spans the distance between the back surface of the stud base of one stud and the front surface of the stud base of an adjacent stud, and said tongue spans the height of said stud sides.

17. A wall according to claim 16 wherein said remote section of said tongue of each of said cross connecting devices also comprises an intermediate portion that extends parallel to said channel base and away from said end tab, and said intermediate portion is perpendicular to both said proximal section and said extremity of said tongue.

18. A wall according to claim 16 wherein said tongue is separated from each of said channel sides by a distance of about one half an inch in each of said cross connecting devices.

* * * * *